US007763136B2

(12) United States Patent
Richards et al.

(10) Patent No.: US 7,763,136 B2
(45) Date of Patent: Jul. 27, 2010

(54) TAPE APPLICATOR

(75) Inventors: Michael C. Richards, Independence, MO (US); James W. Gochenour, Jr., Lee's Summit, MO (US); Stephen C. Richards, Oak Grove, MO (US)

(73) Assignee: Precision Floor Marking, Inc., Grandview, MO (US)

( * ) Notice: Subject to any disclaimer, the term of this patent is extended or adjusted under 35 U.S.C. 154(b) by 0 days.

(21) Appl. No.: 10/410,755

(22) Filed: Apr. 10, 2003

(65) Prior Publication Data

US 2004/0200559 A1 Oct. 14, 2004

(51) Int. Cl.
*B32B 37/22* (2006.01)

(52) U.S. Cl. ..... 156/71; 156/574; 156/577; 156/579

(58) Field of Classification Search ..... 156/577, 156/579, 71, 543, 574, 523; D32/15, 16; 222/608, 613, 611.1, 606; 206/389, 390, 206/391, 411
See application file for complete search history.

(56) References Cited

U.S. PATENT DOCUMENTS 3,892,618 A * 7/1975 Griebat ..... 156/355
4,087,312 A * 5/1978 Maltese ..... 156/552
4,093,494 A * 6/1978 Boettcher ..... 156/577
4,143,462 A * 3/1979 Gertz ..... 33/414
4,221,103 A * 9/1980 Uchida ..... 53/212
4,555,298 A 11/1985 Boucher ..... 156/523
4,608,116 A 8/1986 Braselton ..... 156/523
4,707,202 A 11/1987 Sweeny ..... 156/71
D293,725 S * 1/1988 Kriedeman ..... D32/15
4,765,557 A * 8/1988 Kahmann ..... 242/381.6
4,990,004 A * 2/1991 Kawahara et al. ..... 400/56
4,995,937 A * 2/1991 Persson ..... 156/543
5,038,492 A 8/1991 Bryant ..... 33/758
6,110,093 A 8/2000 Slusarz ..... 493/416
6,125,903 A 10/2000 Uchida ..... 156/540
6,159,323 A 12/2000 Joly ..... 156/241
6,206,990 B1 * 3/2001 Glenn ..... 156/71
6,428,035 B1 8/2002 Maxwell ..... 280/656
6,544,367 B1 * 4/2003 Fujimoto et al. ..... 156/187

FOREIGN PATENT DOCUMENTS

JP 09184281 A * 7/1997

* cited by examiner

*Primary Examiner*—Mark A Osele
(74) *Attorney, Agent, or Firm*—Polsinelli Shughart PC

(57) ABSTRACT

A tape applicator apparatus for applying tape to a surface. The apparatus is configured for application of parallel strips of tape, as lateral plates holding tape are adjusted laterally dependent on the width desired intermediate the tape strips. At least two oppositely disposed tape holders are attached to the lateral plates and are configured collinear to at least two spool members and at least two distal and proximal rollers. The collinear nature of the tape holders, spools, and rollers allow the tape to be applied to the surface in a parallel fashion with a specifically set intermediate distance.

19 Claims, 9 Drawing Sheets

TAPE APPLICATOR

TECHNICAL FIELD

The present invention relates to an apparatus for preparing surfaces, for example floors for painting or striping. In particular, the present invention is directed to an apparatus for placing single or multiple tape strips over a floor to allow lines to be painted in the areas along the lines corresponding to the positioning of the tape.

BACKGROUND

Factories and warehouses typically have lines painted on their floors. These lines are typically used for safety, as they mark an approved and safe walking path over the plant or warehouse floor for workers and visitors.

These lines are typically prepared by a worker laying string or applying tape, typically in parallel strips corresponding to the desired width of the line. This is a tedious practice, taking workers a great amount of time in order to produce straight parallel strips of tape for guidance of paint lines. The accuracy and straightness of the lines depends on human judgment, as an individual must "eye" the path for the string or tape. This process of "eyeing", while standard, typically results in a path for the desired line that is not necessarily straight, and when the two parallel strips are to be applied may not necessarily be of a uniform width, resulting in a line that may be crooked and of variable width.

SUMMARY

The present invention overcomes and eliminates the problems associated with human judgment and "eyeing" of paths for lines, by providing an apparatus that can apply single or multiple, typically two, strips of tape on a surface, in a straight path. In the case where two strips are applied, these tape strips can be applied at a distance substantially parallel to each other, such that a truly straight line of uniform width can be painted.

The present invention is an apparatus for applying tape to a surface. The main body of the apparatus is configured to include a support plate and first and second lateral plates. The lateral plates are configured to allow lateral movement, therefore allowing the distance intermediate the lateral plates to vary. At least two oppositely disposed tape holders are attached to the lateral plates configured for the receipt of a role of tape. At least two spools and at least two distal rollers are positioned collinear with regard to the tape holders.

Typically, the apparatus includes two proximal rollers. The collinear nature of the tape holders, spools, and rollers allows the tape to be applied to the surface in a parallel fashion, or as parallel strips, with a uniform distance between the tape strips (corresponding to the width of the line to be painted). This distance between the tape strips or uniform distance is set by adjusting the distance between the lateral plates. The intermediate distance is fixed by the scale plate, to which the lateral plates lock at a desired position by moving clamping members into contact with the scale plate. A handle member is attached to the proximal end of the main body, with a guide member attached on the distal end of the main body.

Embodiments of the invention are directed to an apparatus for applying tape to a surface. This apparatus includes, a main body, at least one pair of rollers, for example, two pair, each roller of the at least one pair of rollers disposed on opposite sides of the main body, and plate members. These plate members are disposed on opposite sides of the main body, at least one of the plate members including at least one mechanism for feeding tape for being pressed into contact with the surface by the rollers when the apparatus is advanced over the surface. The plate members are typically moveable laterally with respect to the main body, and are typically slideably attached to the main body, typically along axles extending from sides of the main body.

Another embodiment is directed to an apparatus for applying tape to a surface. The apparatus has a main body that includes side plates, with a support plate between the side plates. The side plates are movably coupled to the support plate so as to be movable laterally with respect to the support plate. There is also at least one pair, and typically two pairs, of rollers, each roller of the at least one pair of rollers disposed on opposite sides of the main body. At least one of the side plates includes at least one mechanism for feeding tape for being pressed into contact with the surface by the rollers when the apparatus is advanced over the surface. The side plates are typically slideably attached to the support plate.

Another embodiment is directed to an apparatus for applying tape to a surface, having a main body, at least one pair of rollers, typically two pairs of rollers, each roller disposed on opposite sides of the main body. There is also at least one mechanism for feeding tape for being pressed into contact with the surface by the rollers when the apparatus is advanced over the surface, the tape feeding mechanism in communication with the main body. The main body typically includes a support plate and at least one side plate, typically two side plates, disposed on a side(s) of the support plate, the at least one side plate including the at least one tape feeding mechanism. The side plate(s) are moveable laterally with respect to the support plate, and in particular, the side plate(s) is/are slideably attached to the support plate. Additionally, the at least one mechanism for feeding tape on the side plates includes at least a plurality of tape feeding mechanisms.

The invention also includes an embodiment directed to a method for striping a surface. This method includes, providing an apparatus having a main body, at least one pair of rollers, each roller of the at least one pair of rollers disposed on opposite sides of the main body, and plate members coupled to opposite sides of the main body so as to be movable laterally with respect to the main body, each of plate members including at least one mechanism for feeding tape for being pressed into contact with the surface by the rollers when the apparatus is advanced over the surface. Tape is then placed onto the at least one tape feeding mechanism on each of the plate members, and the plate members are moved, typically laterally with respect to each other, be spaced apart from each other at a desired distance, corresponding to where the tape should be placed to obtain a stripe of corresponding width. Tape is then placed into contact with the rollers, the plate members are locked into fixed positions and the apparatus is moved forward to press the tape into contact with the surface. Throughout this process, tape can be fed continuously into contact with the rollers.

Another embodiment is directed to a method for striping a surface, that includes providing an apparatus of a main body, at least one pair of rollers, typically two pair of rollers, where each roller of the paired rollers is disposed on opposite sides of the main body. There is also at least one mechanism for feeding tape for being pressed into contact with the surface by the rollers when the apparatus is advanced over the surface, the tape feeding mechanism movably mounted on the main body. Tape is provided to the at least one tape feeding mechanism, and the tape is placed in contact with a roller. The apparatus can be moved forward to place the tape into contact with the surface. The tape feeding mechanism can be moved laterally with respect to the main body. Throughout this process, tape is typically continuously fed into contact with the rollers.

BRIEF DESCRIPTION OF THE DRAWINGS

Attention is now directed to the drawing, where like numerals and characters indicate like or corresponding components. In the drawings.

DETAILED DESCRIPTION OF THE DRAWINGS

Figure 1:
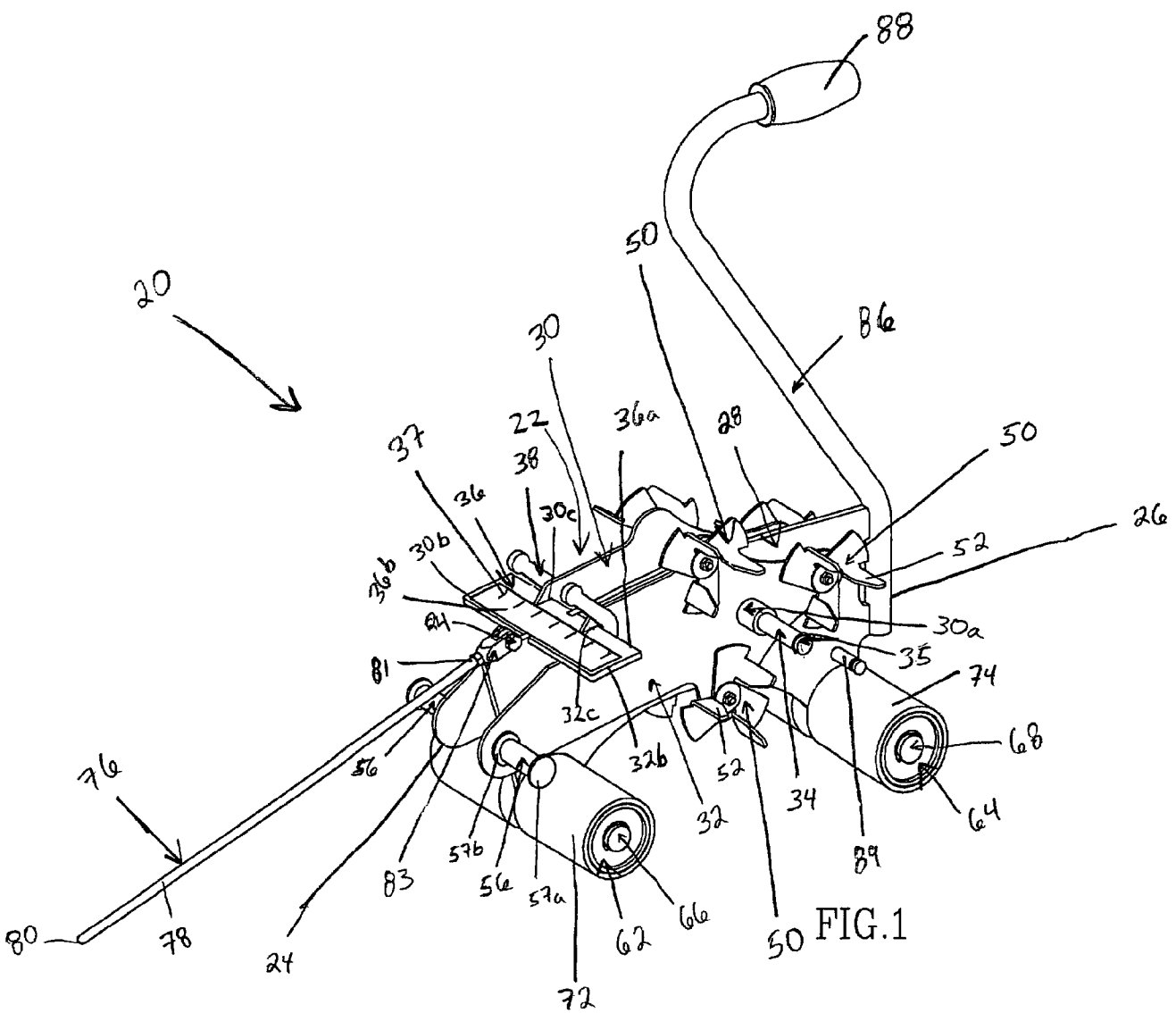
FIG. 1 is a perspective view of an embodiment of the present apparatus.
Figure 2:
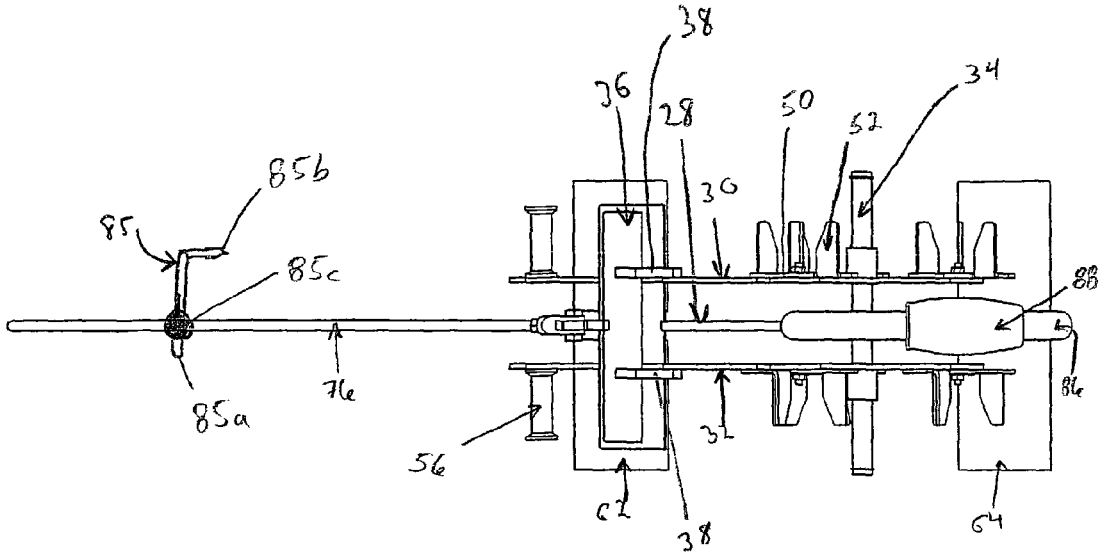
FIG. 2 is a top view of the apparatus of FIG. 1.
Figure 3:
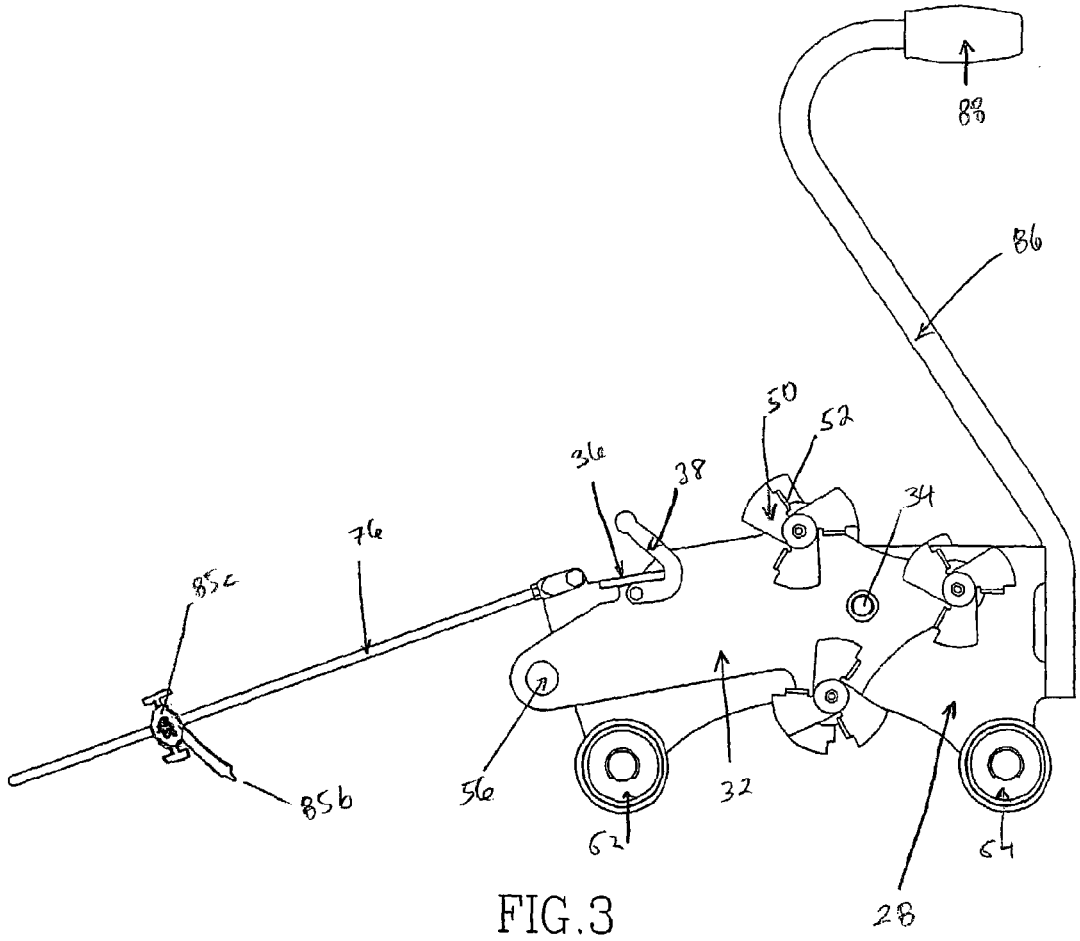
FIG. 3 is a side view of the apparatus of FIG. 1.
Figure 4:
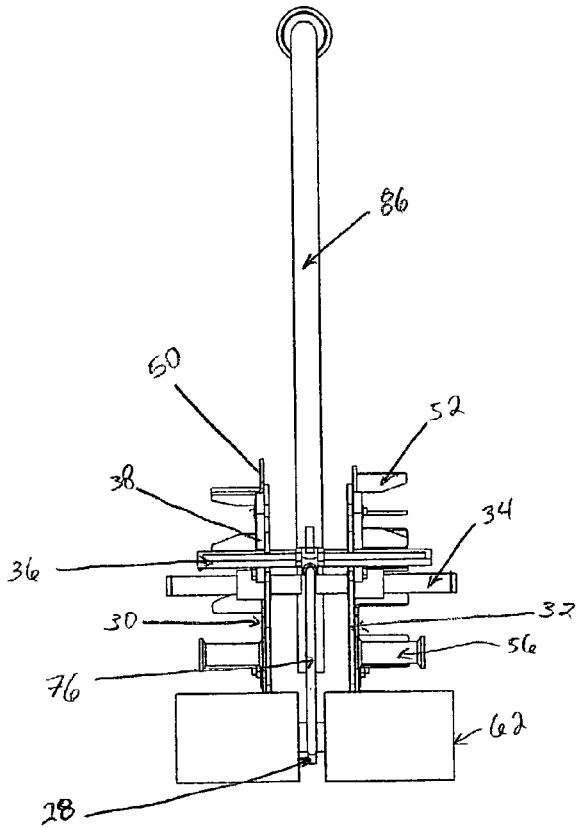
FIG. 4 is a front view of the apparatus of FIG. 1.
Figure 5:
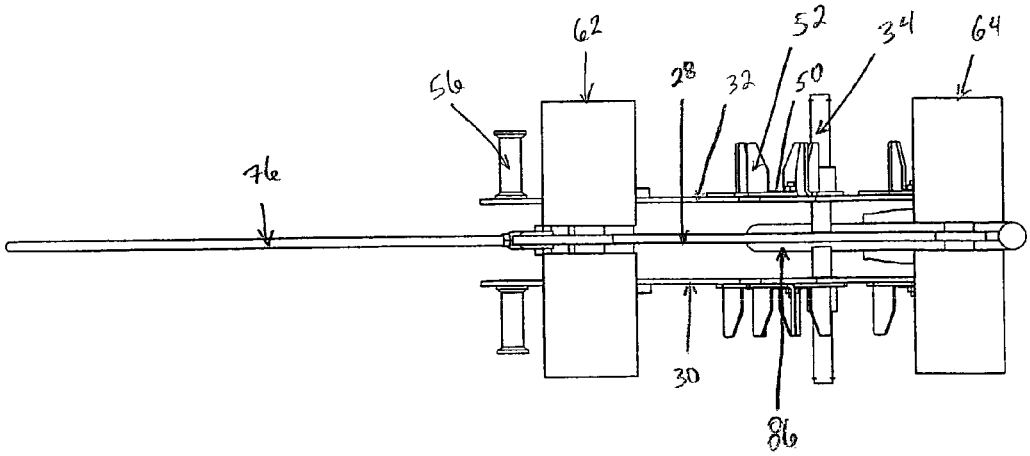
FIG. 5 is a bottom view of the apparatus of FIG. 1.

FIG. 1 shows an apparatus 20 in accordance with an embodiment of the invention. The apparatus 20 is shown for example as a tape dispensing and application apparatus. The apparatus is designed to hold at least one but typically multiple roles of adhesive tape, on one or both of its sides, and then apply the tape to a surface, for example a floor, typically in a straight line.

The apparatus typically includes oppositely disposed tape holders; one on each of the lateral sides at corresponding locations, for use in applying parallel strips of tape to a surface. The parallel tape strips are used to form barriers for the paint as well as serving as a guide for the painter. When paint is placed between these tape strips, a line is created that is straight and of uniform width. The apparatus can be further employed to place a single permanent or temporary tape strip for use in marking a surface.

The apparatus 20 includes a main body 22 having a distal end 24 and a proximal end 26, and a first and second side. The main body 22 of the apparatus 20, is typically formed from a support plate 28 and lateral plates 30, 32. The support plate 28 is intermediate to the lateral plates 30, 32, and serves as the backbone of the apparatus 20 providing stability thereto. This support plate 28 and the lateral plates 30, 32 are typically constructed of steel, or other metal or material that provides the apparatus 20 with sufficient weight for pressing tape into contact with floor surfaces. Other suitable materials may include aluminum, titanium, plastic, wood, and/or any combinations thereof.

Turning also to FIGS. 2-5, an axle member 34, extends from both sides of the support plate 28 and extends through bores 30*a*, 32*a* in the lateral plates 30, 32. The bores 30*a*, 32*a* provide stability to the plates 30, 32 when sliding along axles 34. The lateral plates 30, 32 are slideable along this axle member 34, allowing for their outward and inward movement with respect to the support plates 28. Outward movement is limited by the c-clips 35, at the ends of the axles 34, that because of their portions with a larger diameter than that of the inner diameter of the bores 30*a*, 32*a*, serve as stop surfaces for the lateral plates 30, 32. This slideable movement allows the distance between parallel tape strips to be adjusted as detailed below.

A scale plate 36, for use in adjusting and setting the distance between the lateral plates 30 and 32, is connected to the support plate 28. A portion of the scale plate 36 is received under ledges 30*b*, 32*b*, of the respective lateral plates 30, 32, that define tracks 30*c*, 32*c* therein, for receiving and sliding along the proximal end 36*a* of the scale plate 36. The scale plate 36 typically includes indicia 37 on the surface 36*b*, allowing for reference to the intermediate width of the lateral plates 30, 32 (corresponding to the width of the line to be painted between the tape strips).

Figure 7:
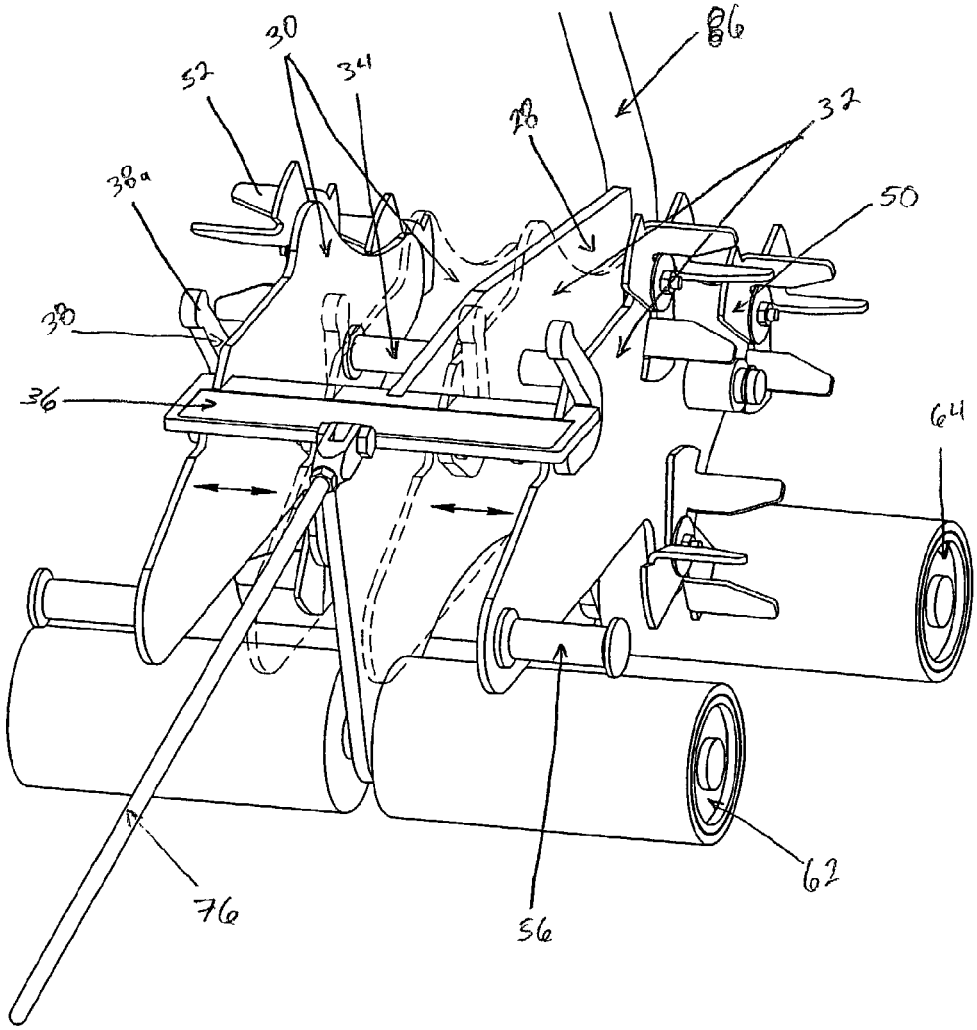
FIG. 7 is a perspective view of the main body of the apparatus from FIG. 1 displaying movement of lateral sides of the main body.
Figure 8:
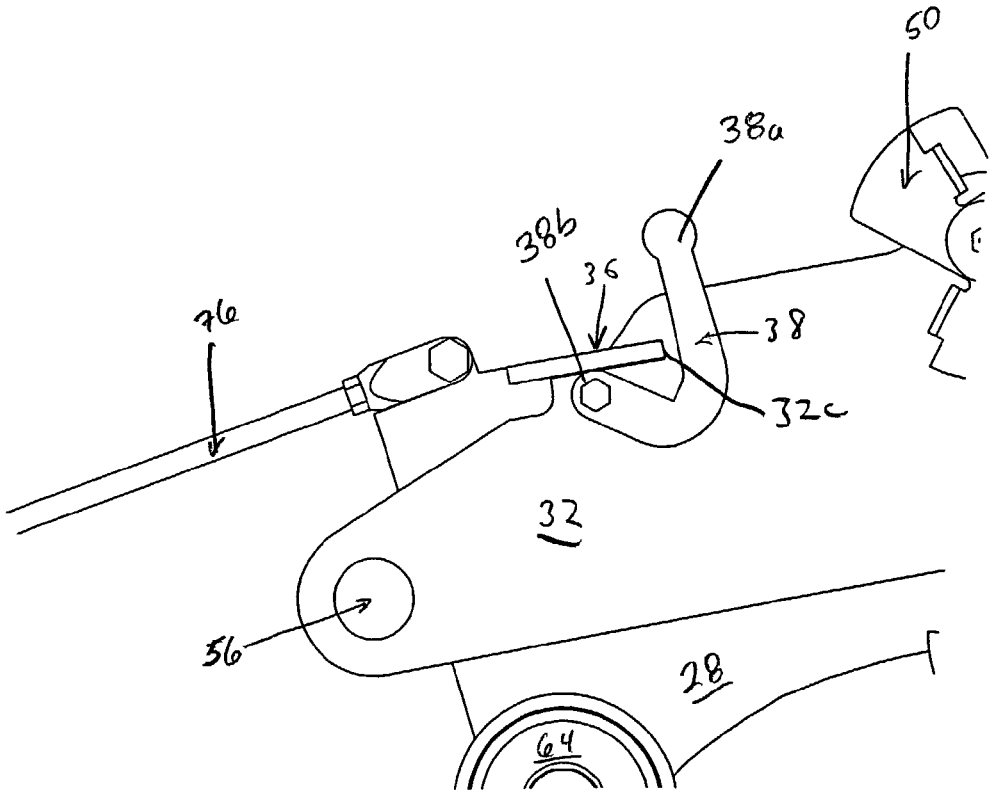
FIG. 8 is a side view of the levers in the locked position after the lateral plates have been moved outward as shown in FIG. 7.

Levers 38 are pivotally connected to each of the lateral plates 30, 32. These levers 38 are typically configured in the shape of a J, with a handle portion 38*a* (FIG. 8) and a contact portion 38*b* (FIG. 8). This contact portion 38*b* typically has an eccentric end, that when in contact with the scale plate 36, locks the lateral plates 30, 32, in their desired positions, as detailed below. These levers 38, by their pivotal connections, are such that they can be moved from a first position (shown in FIG. 7) where the lateral plates 30, 32 are slideable along the respective sides of the scale plate 36, to a second position (shown in FIG. 8) where they have been moved proximally, such that the contact portions 38*b* contact the scale plate 36 at the lower side 36*b*, locking the lateral plates 30, 32 in position.

Figure 6:
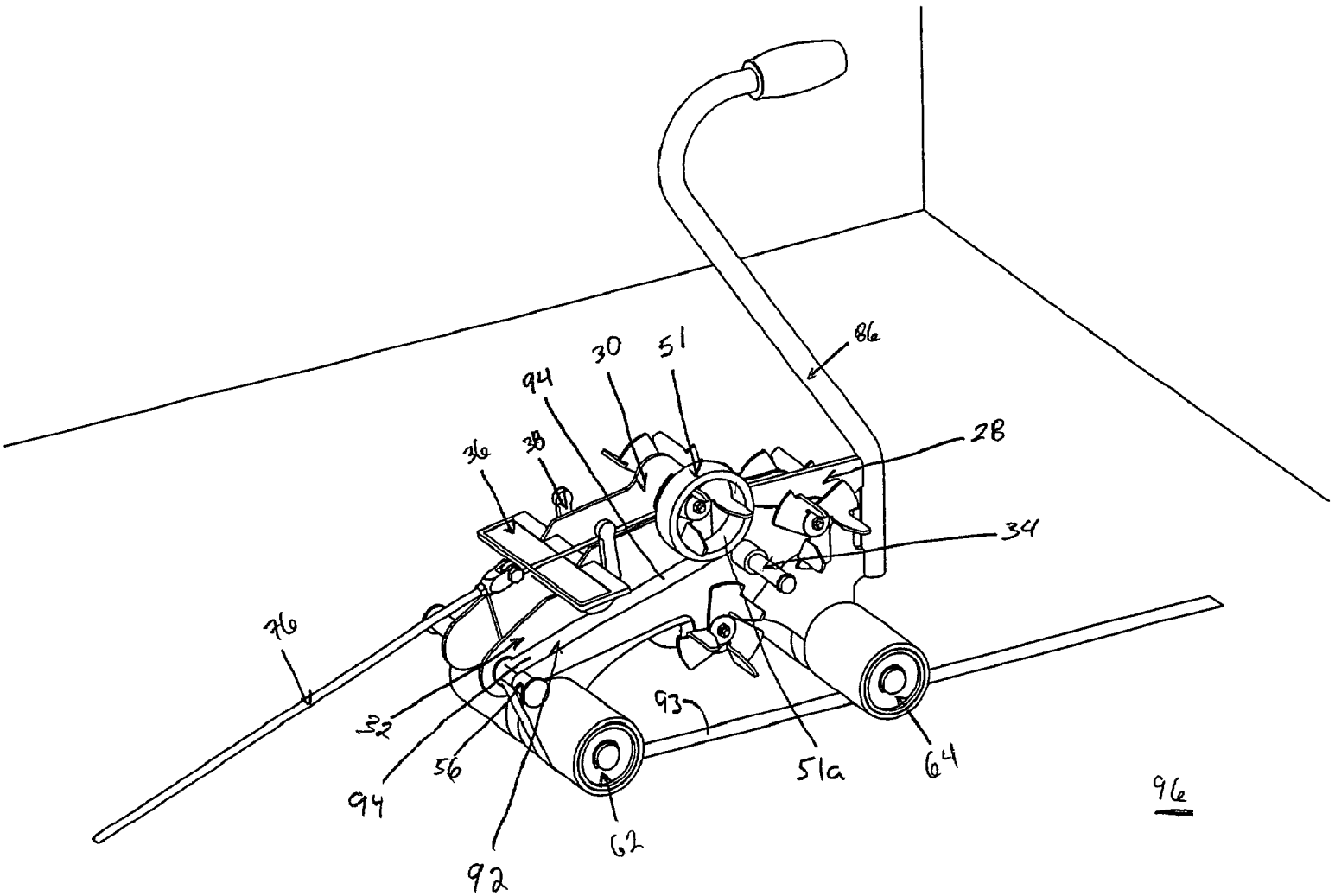
FIG. 6 is a perspective view of an embodiment of the present apparatus in use dispensing and applying tape to a surface.

Lateral plates 30, 32 are typically configured to include one or more tape holders 50, for use in holding a role of adhesive tape, or any strip member configured for placement on a surface. These tape holders 50 are configured, for example, for receiving and frictionally retaining rolls of tape 51 (FIG. 6). Tape roll 51, is typically in roll form, where a coiled tape strip (the tape strip including a smooth or non-adhesive side 93, and a sticky or adhesive side 94, the smooth side 93 substantially inert to the sticky or adhesive side 94, as shown in FIGS. 6 and 9-11) that wraps around a roll 51*a*, for example, a cardboard roll. The roll 51*a*, for example, has with an inner diameter of three inches. Tape rolls 51 can be, for example, masking tape such as Scotch™ 3M Brand Painters Masking Tape of various width sizes, but also any such strip member configured for permanent or temporary placement on a surface.

Accordingly, an exemplary tape holder 50 is a circular member, rotatably mounted to the respective plates 30, 32 allowing for movement of the tape, such that it can be dispensed freely. The tape holder 50 typically includes prongs 52 typically of a diameter equal to or just slightly greater than the tape roll 51 inner diameter, to frictionally engage the tape roll, such that it can be held securely on the tape holder 50. Singular or multiple tape holders 50 are typically positioned on oppositely disposed lateral plates 30, 32. These tape holders 50 are arranged, for example such that once a roll 51 is spent, the spent roll will not obstruct tape from another roll.

Spool members 56 attach to and extend from the lateral plates 30, 32. These members 56 are in alignment (collinear), with the tape holders 50. These spool members 56 provide guidance for the tape before the tape is applied to a surface by the rollers 62 and 64, also in alignment with the tape holders 50 and spool member 56. These spool members 56 are typically cylindrical rods that terminate in a rim or raised ends 57*a*, 57*b* that continue movement of the tape 51 (FIG. 6), to the area between these raised ends 57*a*, 57*b*. This configuration allows for guidance of the tape 51 from the holder 50 to the roller 62. While one spool member 56 is shown for each plate 30, 32, multiple spool members 56 for each plate 30, 32 are also permissible, as they assist in tape alignment and guidance.

The apparatus 20 includes at least one pair of distal rollers 62 located on the distal end of main body 22. However, the apparatus 20, typically includes a pair of proximal rollers 64, in addition to the distal rollers 62, located collinear at the proximal end of the apparatus 20. Typically axles 66, 68 extend through the support plate 28 and support the rollers 62, 64 that are disposed on opposite sides of the support plate 28.

The rollers 62, 64 include portions 72, 74 typically coated with a materials such as plastic, rubber, metal, and any material known in the art, for applying pressure to the tape for adhesion (contact) to the surface. Rollers 62, 64, and in particular, the portions 72, 74 extend outward (laterally) to a point where the spool member 56 and tape holder 50 will remain aligned, when the lateral plates 30, 32 are at their maximum outward extension (as shown in FIG. 7).

A guide member 76 is located on the distal end 24 of the main body member 22 to allow for use in guidance of the apparatus 20 for applying tape in a straight line. Guide member 76 typically is composed of a cylindrical rod 78 with one pointed end 80 pointed and the opposite blunt end 81.

The blunt end 81 of the guide member 76 is removably attached to a forked member 83, or any similar member, such as a clevis, that connects to the support plate 28 by a pin 84. The forked member 83 allows removable attachment of the appropriate guide member 76 dependent on the nature of the job for using apparatus 20. Forked member 83 allows for rotatable horizontal movement of the guide member 76 pivoting on the pin 84. The pin 84 can be any known fastener, such as a bolt, peg, rivet, screw, dowel, and/or any combinations thereof.

Turning back specifically to FIGS. 2 and 3, a secondary guide member is an L-shape guide member 85 for guidance of the apparatus 20 while in use by following existing lines on the surface. The L-Shape guide member 85 is configured with one end 85*a* being blunt and the opposite end 85*b* bent with a point, thus forming a guide member 85 in the shape of an L. The guide member 85 is typically fastened to the guide member 76 by a slideable clasp 85*c*, allowing for the L-shaped guide member 85 to be adjusted along the guide member 76. This sliceable clasp 85*c* also allows for adjustment of the L-guide member 85 in the clasp 85*c*.

An alternate embodiment includes a main body 22 configured with a distal forked receiver for communication with guide member 76. Guide member 76 is attached by a pin 84 to allow rotatable horizontal movement of the guide member 76 pivoting on the pin 84.

A handle 86 is located on the proximal end of apparatus 20. The handle 86 is typically in the shape of a J, although other shapes are also suitable. The handle 86 can be either removably or integrally attached to the main body 22, and can include a rubber grip 88 encasing the end opposite attachment to the main body 22.

A pin 89 (FIG. 1) is located on the proximal end of apparatus 20. The pin 89 is typically configured as a cylindrical rod with a notch to hold a chalk line for pre-marking a straight path for the apparatus 20 to follow. The pin 89 can be on either side of the main body 22, and typically can be on either side of the support plate 28, typically at the proximal end 26.

An example apparatus in accordance with the embodiment above is thirty-nine inches in length by twelve inches in width by thirty inches high. It weighs approximately forty pounds.

Turning also to FIG. 6-11, there is shown and described an exemplary operation of the apparatus 20, that dispenses and applies tape to a surface. While a single strip of tape is shown being applied to a surface, this is exemplary only, to show operation of the apparatus 20, as typically, both lateral plates 30, 32 have rolls of tape, that are applied contemporaneously, and, for example, simultaneously, to create parallel tape strips with an area therebetween of uniform width, to define the desired line or stripe to be painted in this area.

With reference to FIG. 6, initially, the path to be followed must be determined. Optionally, a chalk line can be used to mark a straight line, corresponding to the desired path. The pin 89 (FIG. 1) holds one end of the chalk line, and then the rollers 62, 64 are placed on the chalk line to hold it on the desired mark. An individual, working alone, can then stretch the chalk line and snap the line whereby marking a straight line for the apparatus 20 to follow.

Turning also to FIGS. 7 and 8, the desired width of a painted line for use on a surface is determined. Once the width of the line has been determined, the lateral plates 30 and 32 will be adjusted. Adjustment occurs as the lateral plates 30, 32 in a first position (shown in broken lines) are moved outward, for example, from the first position to positions corresponding to the width of the line (between the tape strips) desired.

Levers 38, on each of the lateral plates 30, 32 are pivotally rotated to release contact with the scale plate 36. The lateral plates 30, 32 are now free to be moved. These lateral plates 30, 32, at a first position are then positioned by sliding on the axle members 34, until the desired intermediate width is obtained, which is typically measured according to the indicia 37 on the scale plate 36.

After the lateral plates 30, 32 are in the desired position, the handle portion 38*a* is pushed proximally allowing the contact portion 38*b* of the lever 38 to come into contact with the scale plate 36, locking the lateral plates 30, 32 in position, as shown in FIG. 8.

After locking the lateral plates 30, 32 in the desired position, one or more rolls of tape 51 are typically placed onto the respective oppositely disposed tape holders 50.

The user typically pulls a tape strip 92, such that it releases from the respective tape roll 51 and its non-adhesive side 93 is passed over the respective spool member 56, between raised rims 57*a*, 57*b*. The tape strips 92 are then placed distal to (forward of) the distal rollers 62, and typically such that the sticky-side 94 of the tape strip 92 contacts and adheres to the floor surface 96.

Figure 9:
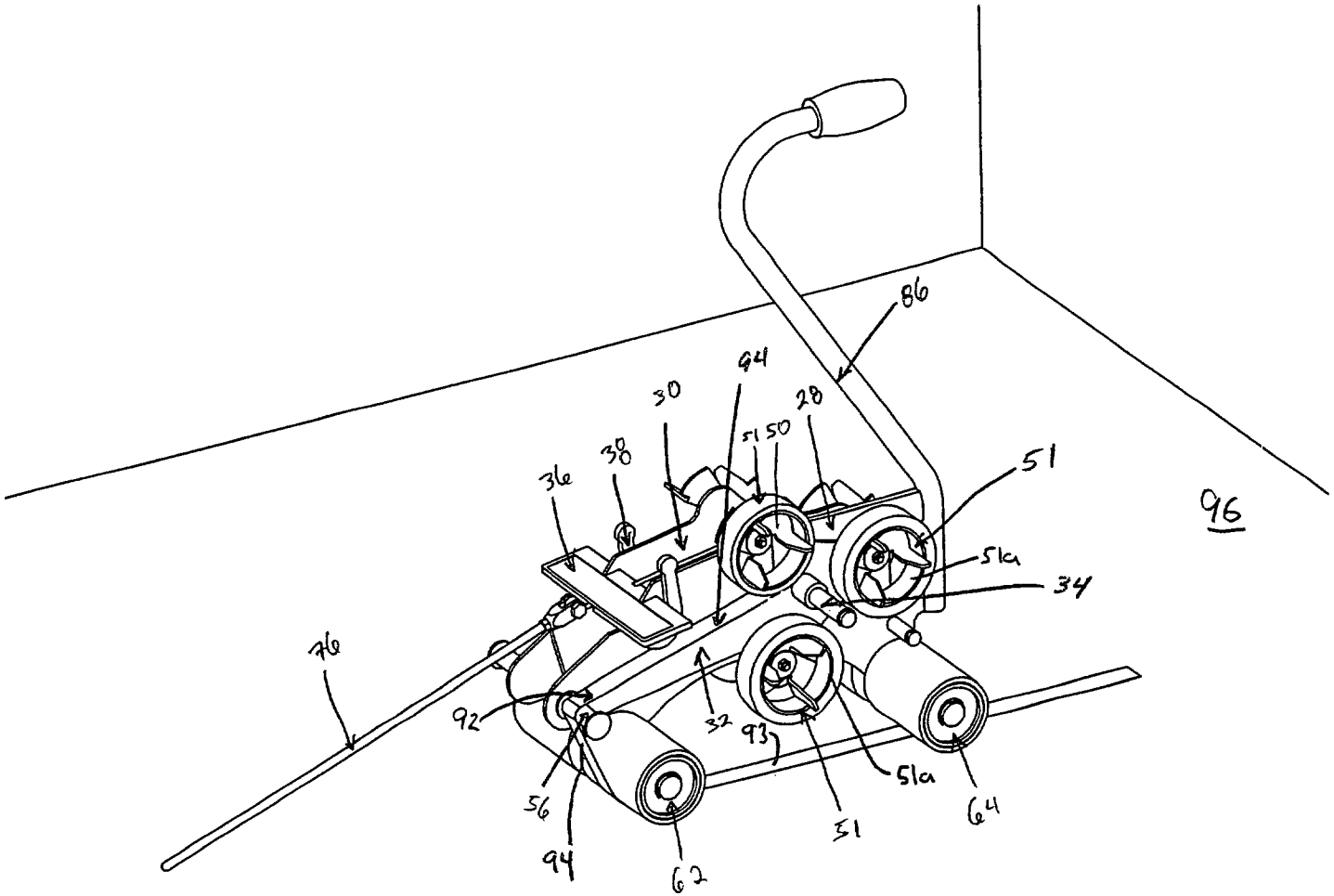
FIGS. 9-11 are perspective views of an embodiment of the present apparatus in an exemplary operation in dispensing and applying tape to a surface.

As shown in FIG. 9, the apparatus 20 is moved forward (distally) following the chalk line, if one was made, through use of the guide member 76. The distal rollers 62 apply pressure to the tape causing adhesion of the tape strips 92 to the surface continuing forward movement further presses the tape strips 92 to the surface by the second set of proximal rollers 64. Tape is continually fed as the tape holders 50 rotate such that tape 51 comes off the spool. The final parallel strips of tape 92 are fixed to the surface and in readiness for painting of the lines.

Figure 10:
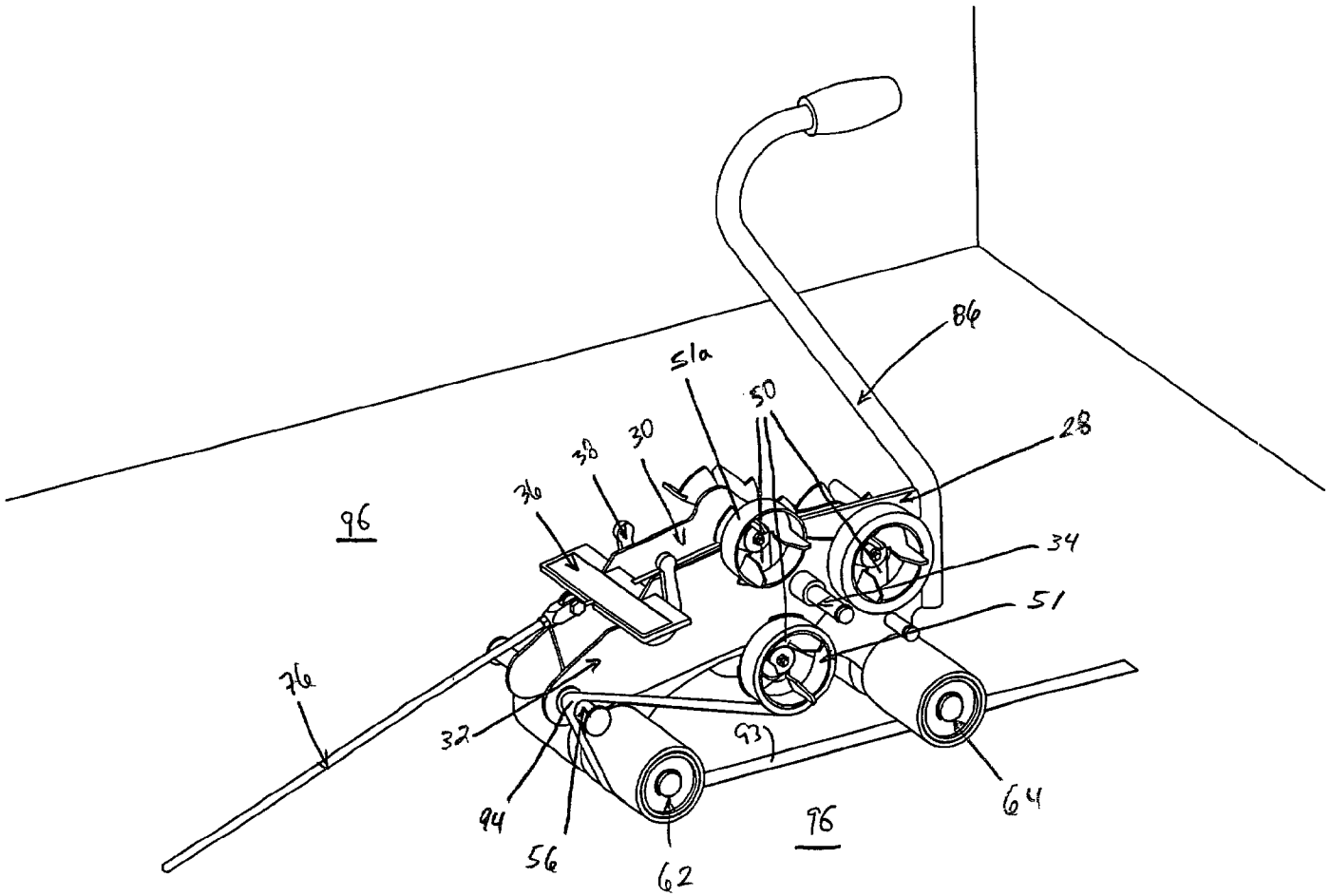
Figure 11:
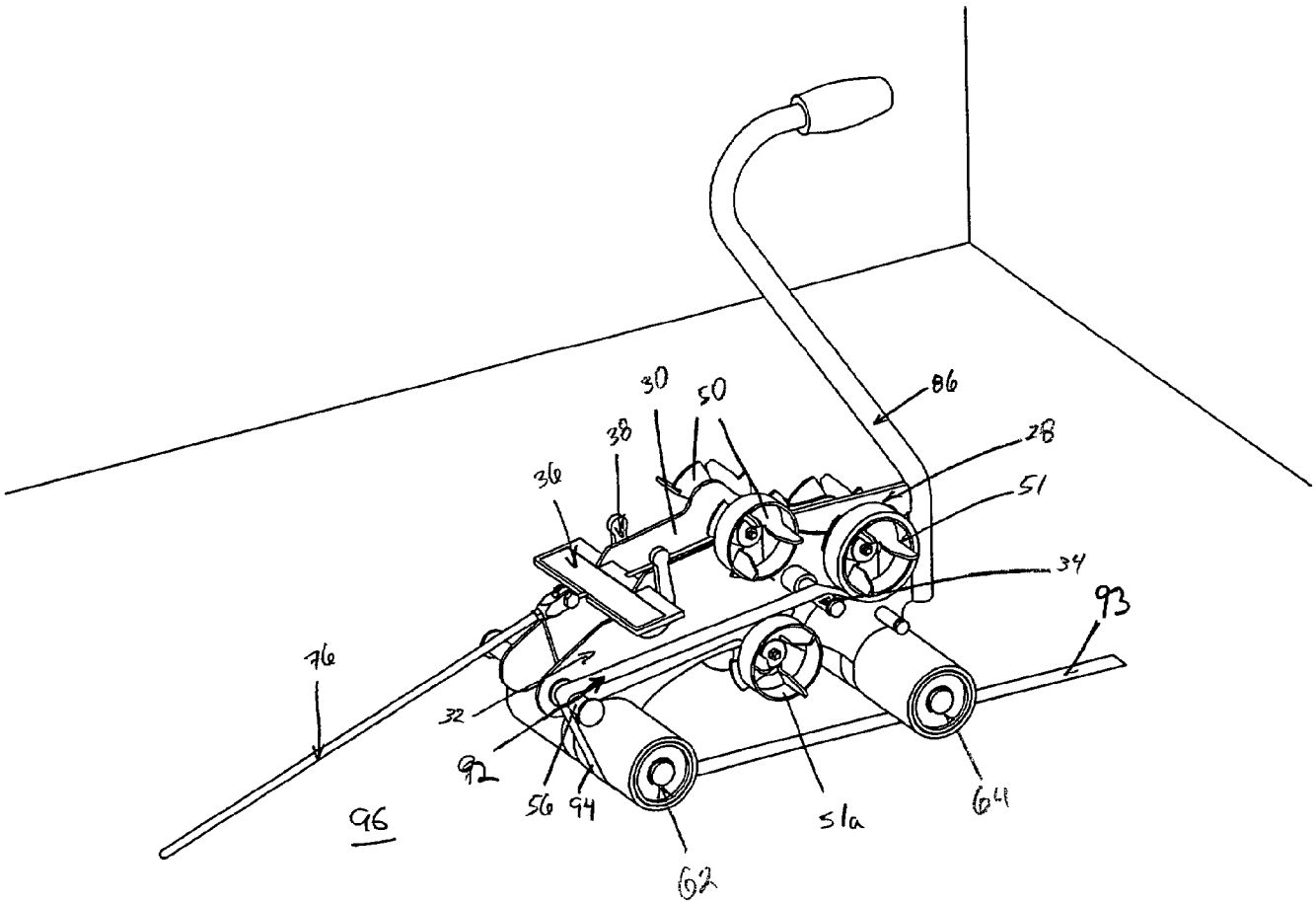

When one tape roll 51 is spent, another can be placed into service. An exemplary order for tape rolls 51 being placed into service is shown in FIGS. 10 and 11, after the first roll of tape is spent, as shown in FIG. 9.

Alternatively, the apparatus 20 can be used to apply striping tape, or any similar adhesive tape for marking, to a surface. The striping tape can be applied to the surface with singular strips or parallel strips dependent on the desired job. One or both of the lateral plates 30, 32 can be used for application. The lateral plates 30, 32 do not have to be positioned equal distance from the support plate 28. In the case of a single lateral plate 30, 32 being used against the support plate 28 or set at a distance from the support plate 28. Alternate embodiments can include only the support plate with tape holders 50 and spool members 56 as detailed above.

There has been shown and described at least one preferred embodiment of an apparatus for dispensing and application of tape. It is apparent to those skilled in the art, however, that many changes, variations, modifications, and other uses and applications for the above-described apparatus and system, including its components are possible, and also such changes, variations, modifications, and other uses and applications which do not depart form the spirit and scope of the invention are deemed to be covered by the invention, which is limited only by the claims which follow.

What is claimed is:

1. An apparatus for applying tape to a surface comprising:

a main body;

a plurality of paired rollers in communication with the main body, each roller of each pair of rollers disposed on opposite sides of the main body;

two plate members, with one plate member disposed on one side of the main body and a second plate member disposed on the opposite sides of the main body, the plate members moveable laterally with respect to the main body, and the plate members are slideably attached to the main body each plate member includes at least two tape roll holders rotatably mounted to the plate member the two tape roll holders are configured in the same plane when attached to the plate member and at least one mechanism for feeding tape for being pressed into contact with the surface by the rollers when the apparatus is advanced over the surface;

a spool member attached to the plate member and configured in the same plane as the two tape rolls; and, a scale plate attached to the main body, the scale plate slideably received in each of the plate members, each of the plate members including a lever member for moving from a first position, out of contact with the scale plate, where the plate member is slideable along the scale plate to a second position, into contact with the scale plate, where the plate member is locked in a fixed position.

2. The apparatus of claim 1, wherein each plate member includes at least three tape roll holders, wherein the three tape roll holders are configured in the same plane when attached to the plate member.

3. The apparatus of claim 2, wherein the main body includes a proximal end and a distal end and at least one pair of rollers is at the proximal end and at least one pair of rollers is at the distal end.

4. The apparatus of claim 3, wherein the rollers are in alignment with each of the at least one tape feeding mechanisms on the respective plate members.

5. The apparatus of claim 1, wherein the main body includes a proximal end and a distal end, and at least one pair of rollers is at the distal end of the main body.

6. The apparatus of claim 5, wherein the main body includes a handle at the proximal end.

7. The apparatus of claim 5, wherein the main body includes a guide at the distal end.

8. The apparatus of claim 5, wherein the main body includes a pin attached at the proximal end, for snapping a chalk line.

9. The apparatus of claim 1, wherein the scale plate includes indicia.

10. A method for a applying tape to a floor surface comprising:

providing an apparatus comprising:

a main body;

at least one pair of rollers, each roller of the at least one pair of rollers disposed on opposite sides of the main body; and, plate members movably coupled to opposite sides of the main body so as to be movable laterally with respect to the main body, each of the plate members includes at least two tape roll holders configured on the same plane when attached to the plate members a spool member on the same plane of the tape roll holders and including at least one mechanism for feeding tape for being pressed into contact with the surface by the rollers when the apparatus is advanced over the surface;

placing tape onto at least one of the tape roll holders on each of the plate members;

adjusting the plate members such that they are spaced apart from each other at a desired distance; and, placing tape in contact with the rollers, including placing the tape over the rollers.

11. The method of claim 10, additionally comprising: locking the plate members into fixed positions.

12. The method of claim 11, additionally comprising: moving the apparatus forward to place the tape into contact with the surface.

13. The method of claim 12, additionally comprising: continuously feeding tape into contact with the rollers.

14. An apparatus for applying tape to a surface comprising:

a main body;

a plurality of paired rollers in communication with the main body, each roller of each pair of rollers disposed on opposite sides of the main body;

a platform extending laterally from the main body;

plate members disposed on opposite sides of the main body, the plate members moveable laterally with respect to the main body, each plate member includes at least two tape roll holders rotatable mounted to the plate member wherein the two tape roll holders are configured in the same plane when rotatable mounted to the plate member a spool member configured on the plate member in the same plane as the tape roll holders and at least one mechanism for feeding tape for being pressed into contact with the surface by the rollers when the apparatus is advanced over the surface, and each of the plate members laterally moveable along the platform; and, engaging mechanisms in communication with each of the plate members, and configured for engaging at least a portion of the platform, for at least temporarily retaining each of the plate members in a fixed position with respect to the main body.

15. The apparatus of claim 14, wherein the plate members are slideably attached to the main body.

16. The apparatus of claim 14, wherein the main body includes a proximal end and a distal end, and at least one pair of rollers is at the distal end of the main body, and at least one pair of rollers is at the proximal end of the main body.

17. The apparatus of claim 16, wherein the rollers are in alignment with each of the at least one tape feeding mechanisms on the respective plate members.

18. The apparatus of claim 14, wherein the main body includes a handle at the proximal end.

19. The apparatus of claim 14, wherein the platform defines a scale plate that includes indicia.

* * * * *